United States Patent [19]

Curley et al.

[11] 4,439,001

[45] Mar. 27, 1984

[54] IDC SOCKET CONNECTOR

[75] Inventors: James H. Curley, Van Nuys; Roger J. Lang, Garden Grove, both of Calif.

[73] Assignee: Allied Corporation, Morris Township, Morris County, N.J.

[21] Appl. No.: 375,921

[22] Filed: May 7, 1982

[51] Int. Cl.[3] ..... H01R 13/50

[52] U.S. Cl. ..... 339/176 MP; 339/97 R; 339/98

[58] Field of Search ..... 339/17 C, 17 F, 17 R, 339/258 R, 258 P, 220, 221, 176 MF, 176 MP, 339, 96, 98, 99 R, 97 R, 256 R, 217 S

[56] References Cited

U.S. PATENT DOCUMENTS

| | | | |
|---|---|---|---|
| 3,267,410 | 8/1966 | Baer et al. | 339/17 F |
| 3,566,342 | 2/1971 | Schmitt et al. | 339/258 P |
| 3,665,378 | 5/1972 | Hammell | 339/256 R X |
| 3,820,055 | 6/1974 | Huffnagle | 339/17 F |
| 3,862,792 | 1/1975 | Jayne | 339/258 R X |
| 3,963,319 | 6/1976 | Schumacher et al. | 339/176 MF |
| 4,040,704 | 8/1977 | Huber | 339/176 MF |
| 4,118,096 | 10/1978 | Takahashi | 339/99 R |
| 4,253,722 | 3/1981 | Fox, Jr. | 339/176 MF |

FOREIGN PATENT DOCUMENTS

| | | | |
|---|---|---|---|
| 2026256 | 1/1980 | United Kingdom | 339/99 R |

*Primary Examiner*—William R. Briggs
*Attorney, Agent, or Firm*—James P. DeClercq

[57] ABSTRACT

A multi-socket connection device, forming an electrical connection with flat ribbon cable, contains a series of individual connectors mounted in a multi-socket connector body. The connector body has a recess for accepting individual connector members and for holding the connector in engagement with the body. The connector member is aligned in its socket to resists displacement of the connector from the socket when a second connector is placed in an electrical engagement with the connector. Additionally, the connector has a means for engaging a cap. The cap is placed on top of the wires forcing the wires down into the connector to form an electrical connection and a latch means on the connector engages the cap to hold the cap firmly in place in the assembled position.

13 Claims, 6 Drawing Figures

IDC SOCKET CONNECTOR

FIELD OF THE INVENTION

This invention relates to electrical connectors for flat ribbon cable.

The Prior Art

There are many well-known electrical terminals used in an insulation displacing manner to form an electrical connection with multi-conductor cable of the planar or flat conductive type. Examples are shown in U.S. Pat. No. 4,169,646 and U.S. Pat. No. 3,820,055.

The current technique for using the multi-terminal connector is to mount connectors in a multi-socket body with the mating portion of the connector exposed. The insulated wires of the planar cable are then individually layed in the respective connector mating portions and a cap is operatively brought over the wires, forcing the wires down into the connector which displaces the insulation from the wire, forming an electrical connection between the wire and the mating portion of the connector. The cap is typically latched in place to the body the connectors and a complete integral connector is formed.

These connectors then have a capability of rapidly forming a number of connections with a plurality of wires and flat ribbon cable without the necessity for separately stripping the insulation from each individual wire in the cable and separately forming the connection with each of the individual connectors.

The connectors additionally have ends for forming connections between a second wire which plugs into the socket body and the individual connectors in the respective sockets. These second wires may be connectors on a printed circuit, for example.

SUMMARY OF THE INVENTION

This invention is a multi-socket connection device for forming an electrical connection with a plurality of wires in an insulated planar cable and with a plurality of second wires, for electrical connection to each respective planar cable insulated wire.

Its parts are a first body which define a plurality of channels or sockets opening onto a first side of the body, and opening onto a second side of the body. A connector is mounted into each channel or socket. The individual connectors have a first end at the first opening, for receiving the second wire and forming an electrical contact, and a second end at the second opening for engagement with respective ones of the insulated wires. The second end of the connector has a latching means to engage a holding means on a second body which may be used with the first body, to latch the second body to the first body.

The second end of the connector additionally has a positioning means for initially locating the insulated wire on the connector, and an insulation displacing connector (IDC) means for forming an electrical contact with the insulated wire. The second body or cap has means for engaging the insulated wire and displacing the insulated wire from the positioning means to the IDC means, responsive to movement of the second body or cap towards the first body. The connector additionally has a stabilizing means, located between the connector latching means and the IDC means, to prevent displacement of the IDC means in response to the engagement of the latching means by the holding means on the second body or cap, when the cap is latched to the connectors.

The positioning means on the connector second end is a wide slot which opens into a narrower slot. The narrower slot is the means for forming the insulation displacing contact. The wires are placed in the wider slot and the second body or cap is driven towards the first body, forcing each wire of the planar cable down into the narrower slot forming the IDC means. The narrower slot displaces the insulation from the wire and forms the electrical contact with the wire.

The stabilizing means mentioned may be a portion of the connector body which separates the latching means at the second end of the connector from the IDC means at the second end of the connector. The latching means is displaced as the second body or cap is placed into engagement with the first body, and is displaced into operative engagement with the mating portion or holding means of the second body to latch the connector second end firmly onto the second body or cap and hold the second body or cap firmly to the connector.

Because of the stabilizing means, the insulation displacing means remains substantially immovable responsive to displacement of the latching means. In this way, the connections can be more securely made, representing a more stable connection as the IDC forming the operative connection with the planar cable wire remains in its initial intended state and shape, without any distortion due to movement of the latching means and without any reduction in the quality of the connection.

Additionally, each connector includes a third means for engaging the multi-socket first body. The third means is oriented to oppose the force produced by a second wire in the connector when the second wire is inserted through the first opening in the first body for connection to the first end. The third means is an insert which fits into a recess in the first body. The insert may be barbed or wider than the recess so it engages the recess walls and opposes any motion of the connector driving the connector out of the first body. Consequently, when a second wire is placed into each individual socket and connector, the insert engaged with the first resists the force of the second connector, and resists any motion tending to displace the connector from the first body.

Accordingly, it is an object of the invention to provide a multi-socket body for holding a plurality of connectors for forming electrical connections with the individual wires of a planar cable.

It is another object of this invention to provide individual connectors for insertion into respective sockets of the multi-socket body to hold the connectors in position for alignment with the planar cable and where the connectors have means for latching to a second body which forms a cap with the multi-socket body when the full connector is assembled.

It is another object of this invention to provide the latching means on the connector, separated from the IDC portion of the connector, to isolate the IDC portion from the latching means, to prevent displacement and distortion of the IDC when the latching means is displaced and latched to the connector cap.

It is another object of this invention to provide a connector with an insert for fastening each connector to the multi-socket body, preventing movement of the connector when a second wire is brought into contact with the connector, when making an electrical connection with the planar cable.

These and other features of the invention will be disclosed in detail in the following.

DESCRIPTION OF THE PREFERRED EMBODIMENT

Figures 1A, 1B, 1C:
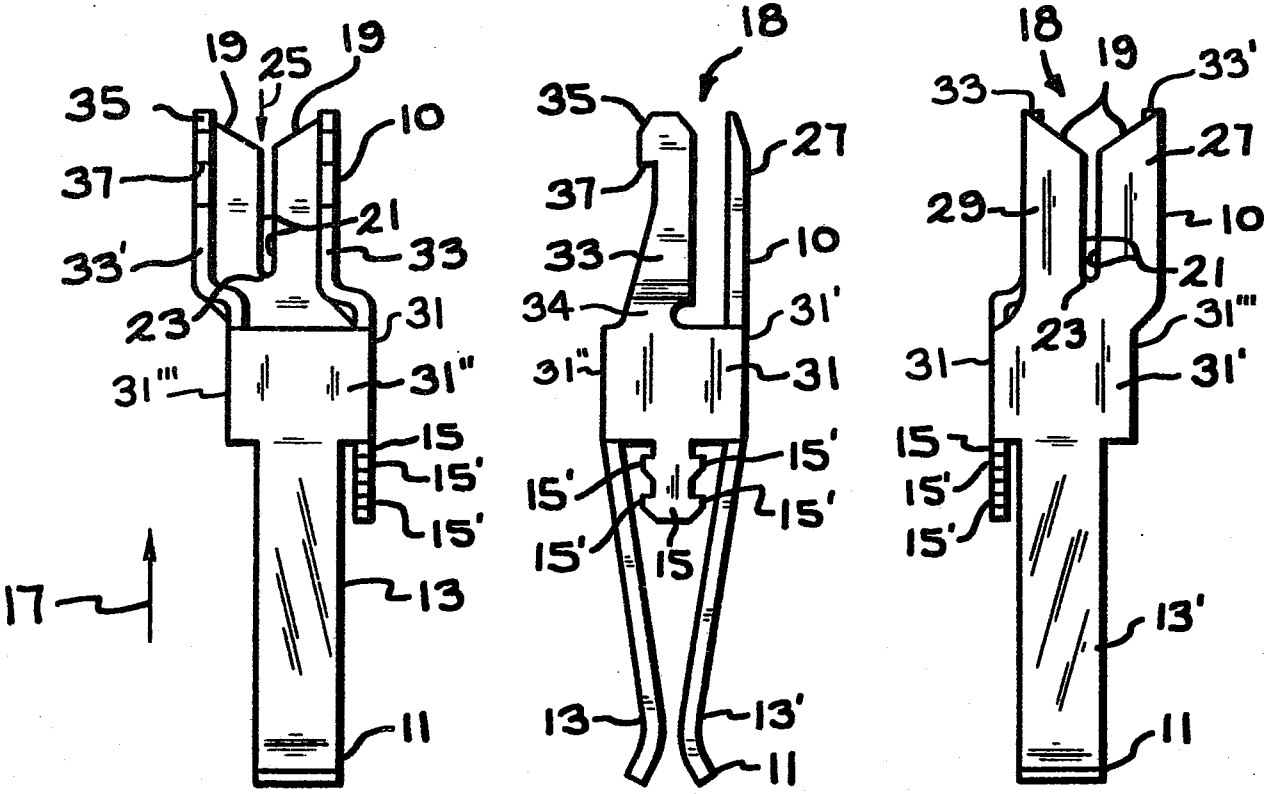
FIGS. 1*a*, 1*b*, and 1*c* show front, side and back views of the connectors which are mounted in respective sockets of the multi-socket body.

The connectors formed of a conductive material are shown in FIGS. 1*a*, 1*b*, and 1*c* in front, side and back views.

As seen in the front view 1*a*, the connector indicated generally as 10 contains a first end 11 for engaging a wire inserted into said first end and for holding the wire in electrical contact with the connector 10. The first leaves, 13 and 13', which may be resiliently mounted to the body of the connector 10, for receiving a wire between the leaves and for forming a resilient contact are well-known in the art.

The connector 10 additionally has a means 15 which serves as an insert for holding a connector in a recess in the socket body.

As shown, the insert has a series of barbs 15' which engage the walls of the socket recess in the socket body and prevent displacement of the connector 10 in the direction of arrow 17 in response to the force of a wire being inserted into the first end 11 of the connector.

The connector 10 additionally has a second end 18. The second end includes a positioning means shown as the wide opening defined by the inclined surfaces 19, and a narrower opening defined by the surfaces 21 and end 23 for displacing the insulation from the wire to form an electrical contact between the wire and the connector 10. The surfaces 21 also define a path between the positioning means defined by surfaces 19 and the IDC means at end 23. The wire is driven from the positioning means through the path shown as 25 to the IDC and the contact forming end 23.

Additionally, the path shown as 25 may have converging surfaces 21, or the surfaces may be straight, the insulation being displaced as the wire is driven from the positioning means defined by walls 19 into the path 25 and with full contact being made with the wire when it is located at end 23.

The connector is shown as having arms 27 and 29 integral with side 31' and with surfaces 19 and 21 being on the internal portions of the arms 27 and 29, facing each other, and the end 23 being at the junction of arms 29 and 27.

As further shown, the connector has a stabilizing means which is shown as a portion extending around the connector in at least three sides, and illustrated having four sides shown as 31, 31', 31'' and 31'''. Sides 31' and 31'' are shown as perpendicular to sides 31 and 31'''. The stabilizing means isolates the arms 27 and 29 from the latching means shown as members 33 and 33', at the second end 18 of the connector and integral with sides 31 and 31'''.

Figure 3:
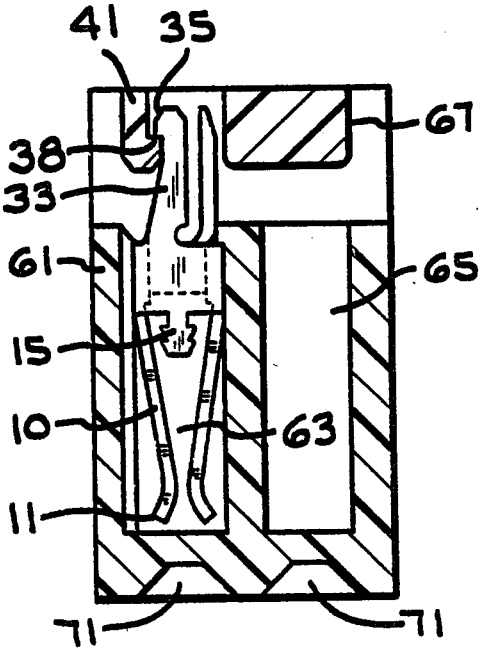
FIG. 3 is a cross-sectional side view of the socket connector showing a connector in one of the respective sockets in the socket body.
Figure 4:
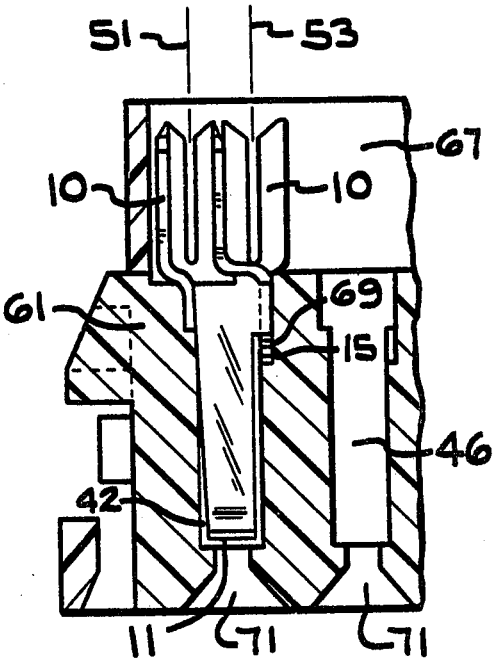
FIG. 4 is a cross-sectional front view of the socket showing a connector mounted in one socket body with an offset connector partially shown alongside.

In particular, each member 33, 33' of the latching means includes a surface shown as 35 which cooperates with a second body or cap, and which is cammed by the cap to force the latching surface 37 into contact with a holding means 38, shown in FIGS. 3 and 4, on the cap to latch the connector to the cap when the cap is brought into contact with the multi-socket first body, and the wires are driven from the positioning means to the IDC means. Although the latching means illustrated includes two members 33, 33', a single member should be functionally adequate.

The stabilizing means, although shown as an isolating portion of the connector, can be any means which separates the IDC means from the latching means or any other movable part, and prevents displacement of the IDC means or blocks any force transmitted from the latching means to the IDC means. In particular, the stabilizing means should prevent movement or distortion of the IDC means holding the wire when the latching means or any other movable portion of the connector is displaced. Preferably, as illustrated, the IDC means and latching means lie in perpendicular planes, to minimize the effect of latching forces on the IDC means.

Figure 2:
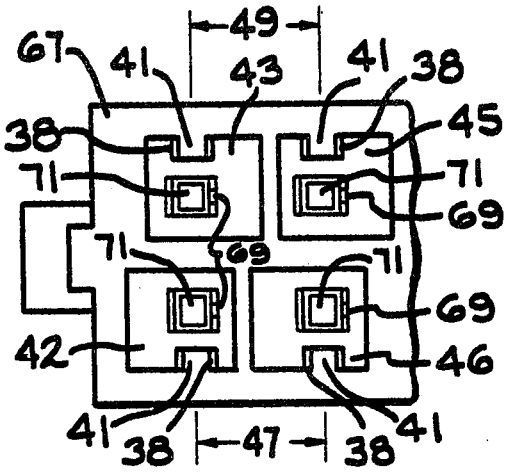
FIG. 2 shows a top view of the full connector assembly in partial form, with adjacent sockets for mounting the individual connectors shown offset with respect to the center line of each connector.

The assembled connector in partial form is shown in FIGS. 2, 3, and 4.

FIG. 2 shows a top view of an assembled connector containing a series of sockets 42 through 46, shown without individual connectors for clarity. Second body or cap member 67 includes protrusions 41, disposed between arms 33, 33' of connectors 10 when installed, forming a plurality of guide portions for guiding the second body at assembly.

As shown, sockets 43 and 45 have their center spacing or first-end connector axis spacing 49 aligned with the center to center spacing 47 or first-end connector axis spacing of opposed sockets 42 and 46. These aligned first-end axes define a plane, the second ends of connectors disposed in opposed sockets being disposed on opposite sides of this plane.

Although opposed sockets are aligned, the offset of the connectors shown in FIGS. 1*a*, 1*b*, 1*c* allows the center lines or axes of the planar cable to match the center lines or axes of the connector second ends shown as 51, 53, even though the center to center spacing of the sockets is considerably larger than the center to center spacing of the wires of the planar cable.

A side view of the multi-socket assembly is shown in FIG. 3, with the first multi-socket body shown as 61 and the second body or cap shown as 67. A connector 10 is shown in a respective socket 63, while an adjoining socket 65 is shown empty.

The second body shown as cap 67 is shown with a holding means 69 engaged with arm 33 and latching surface 37 so the second body is latched to the connector 10 and held into position.

As is well-known in the art, the second body 67 is brought down on the connector when the wires are positioned between surfaces 19 of the positioning means of the first end. Further movement of the second socket body forces the wires through path 25 into the IDC means forming the connection of the wire to the connector at end 23.

As shown in FIG. 4, the sockets 42, 43, 45, 46 for receiving the connectors 10 in the first body are shown offset, having a recess 69 for receiving insert 15.

As can be seen, when a wire is inserted in socket opening 71 of the first body, and into end 11 of the connector, the barbs 15' on the insert 15 resist the force of the wire and maintain the connector in the socket body.

The means for stabilizing can be as shown, formed of a portion of the connector defined by sides 31, 31', 31'' and 31''' and with the latching means 33, 33' having a width reduced at area 34 where the latching means is joined to the stabilizing means, allowing latching means 33, 33' to bend or pivot at area 34.

The means for joining the latching means to the stabilizing means may be changed to provide any other type of pivot means for displacing the latching means under the force of the second body and additionally reducing the force transmitted from the latching means to the IDC means to provide a greater level of isolation, and numerous other modifications and variations and modifications of the invention may be made by one skilled in the art without departing from the spirit and scope of the invention.

I claim:

1. A multi-socket connection device for forming an electrical connection with a plurality of first wires of an insulated planar cable and a plurality of second wires for electrical connection to each first wire, comprising:

a first body, a second body, said first body defining a plurality of sockets, each said socket having a first opening onto a first side of said first body and a second opening onto a second side of said first body, a connector mounted in each said socket and having a first end at said first opening for receiving one said second wire and forming an electrical contact at a second end at said second opening for engagement with a respective one of said insulated wires, said second end of said connector having a latching means to engage a holding means on said second body, said second end having a positioning means for locating said insulated wire on said connector and an insulation displacing means for forming an electrical contact with said insulated wire, said second body having means for engaging said insulated wire and displacing said insulated wire from said positioning means to said insulation displacing means responsive to said second body being driven towards said first body, and where the improvement comprises said connector having a stabilizing means perpendicularly separating said connector latching and insulation displacing means to prevent displacement of said insulation displacement means responsive to the engagement of said latching means by said second body, said latching means being disposed perpendicular to said insulation displacing means.

2. The connection device of claim 1, wherein said connector includes coupling means for engaging said first body, said coupling means being oriented to oppose the force produced by said second wire on said connector when said second wire is inserted through said first opening and into said connector.

3. The connection device of claim 2, wherein said second end of said connector extends externally of said first body, latching means being external of said first body and having a latching surface and a camming surface for engagement with said second body, said holding means including means positioned to cooperate with said camming surface to displace said latching surface into engagement with said holding means, said latching surface being displaced to latch said connector to said holding means on said second body and to latch said second body to said first body responsive to said displacement.

4. The connection device of claim 3, wherein said positioning means of said connector defines an opening larger than the width of the insulated wire and said insulation displacing means defines an opening less than the width of the non-insulated wire, and said second end includes a path between said position means and said insulation displacing means.

5. The connection device of claim 4, wherein said insulated wires of said planar cable are mounted in the said respective positioning means with the planar cable defining a plane substantially perpendicular to the axis of said sockets.

6. The connector device of claim 4, where said plurality of sockets is aligned in at least two rows, each pair of adjacent sockets in the first row and second row defining a center to center socket spacing and with each said socket in said first row having an opposed socket in said second row said cable having a center to center wire spacing less than the said center to center socket spacing and with said second end of said connectors in first and second rows being offset relative to said connector first end to allow a center to center spacing between connectors in opposed sockets less than the adjacent socket center to center spacing and substantially that of the said wire center to center spacing.

7. The connection device of claim 6, wherein said first end of said connector defines a first axis for receiving said second wire, said positioning means, said insulation displacing means and said path between defining a second axis, said connector first axes in opposed sockets defining a plane passing through each said first axis, and with the connector second end and said second axis being offset with respect to the said first axis and with said connectors in opposed sockets having their respective second axis located on opposite sides of said plane.

8. The connection device of claim 2, wherein each of said sockets includes a recess for receiving said coupling means and said coupling means including means to engage said recess walls and oppose withdrawal of said connector from the said socket.

9. The connection device of claim 1, wherein said stabilizing means includes a means for mounting said latching means and said insulation displacing means, said mounting means being connected to said first end and said second end of said connector and with said latching means and said insulation displacing means displaced from each other and separated by said mounting means.

10. The connection device of claim 9, wherein said mounting means includes a coupling means for engaging said first body, said coupling means being oriented to oppose the force produced by said second wire on said connector when said second wire is inserted through said first opening and into said connector first end.

11. The connection device of claim 10, wherein said coupling means is positioned to oppose the force produced by said cable and transmitted to said connector insulation displacing means and said latching means.

12. The connection device of claim 1, wherein said latching means includes means for pivoting, said means for pivoting connecting said latching means to said stabilizing means, and reducing the force transmitted from said latching means to said insulation displacing means.

13. A multi-socket connection device for forming an electrical connection with a plurality of first wires of an insulated planar cable and a plurality of second wires for electrical connection to each first wire, comprising:

a first body;

a second body;

said first body defining a plurality of sockets, each said socket having a first opening onto a first side of said first body and a second opening onto a second side of said first body;

a connector mounted in each said socket and having a first end at said first opening for receiving one said second wire and forming an electrical contact, and a second end at said second opening for engagement with a respective one of said insulated wires, said second end of said connector having a latching means to engage a holding means on said second body;

said second end having a positioning means for locating said insulated wire on said connector and an insulation displacing means for forming an electrical contact with said insulated wire;

said second body having means for engaging said insulated wire and displacing said insulated wire from said positioning means to said insulation displacing means responsive to said second body being driven towards said first body; and where the improvement comprises said connector having a stabilizing means separating said connector latching and insulation displacing means to prevent displacement of said insulation displacing means responsive to the engagement of said latching means by said second body;

said latching means including means for pivoting, said means for pivoting connecting said latching means to said stabilizing means, and reducing the force transmitted from said latching means to said insulation displacing means.

* * * * *